US005354137A

United States Patent [19]

Verdun et al.

[11] Patent Number: 5,354,137

[45] Date of Patent: Oct. 11, 1994

[54] RIBBON RE-INKING METHOD AND APPARATUS

[76] Inventors: Barry L. Verdun, 1266 B Highway 1; Nelson A. Verdun, Jr., 313 Hermitage Dr., both of, Thibodaux, La. 70301

[21] Appl. No.: 981,235

[22] Filed: Nov. 25, 1992

[51] Int. Cl.[5] ..... B41J 31/14

[52] U.S. Cl. ..... 400/197; 400/200

[58] Field of Search ..... 400/197, 200, 194, 249; 118/672, 676, 679, 682

[56] References Cited

U.S. PATENT DOCUMENTS

| | | | |
|---|---|---|---|
| 849,143 | 4/1907 | Langen | 400/201 |
| 1,304,367 | 5/1919 | Pullen | 400/202.4 |
| 2,644,766 | 7/1953 | Levine | 106/271 |
| 3,232,406 | 2/1966 | Schwartz | 191/171 |
| 3,241,522 | 3/1966 | Knight | 118/260 |
| 3,400,801 | 9/1968 | Swenson | 191/171 |
| 4,126,715 | 11/1978 | Schiffmacher et al. | 427/141 |
| 4,390,294 | 6/1983 | Castro | 400/202.4 |
| 4,948,275 | 8/1990 | Kuhn et al. | 400/200 |
| 5,005,997 | 4/1991 | Chung | 400/197 |
| 5,035,522 | 7/1991 | Wright | 400/197 |
| 5,048,986 | 9/1991 | Czesnik et al. | 400/197 |
| 5,071,271 | 12/1991 | Chang et al. | 400/202.4 |
| 5,110,229 | 5/1992 | Ide | 400/249 |

*Primary Examiner*—Ren Yan

*Attorney, Agent, or Firm*—Pravel, Hewitt, Kimball & Krieger

[57] ABSTRACT

A system for re-inking ribbons in ribbon cartridges includes a base, a securing shelf for securing a ribbon cartridge to the base, and a motor for turning the ribbon driver of the ribbon cartridge. There is a variable-diameter coupler for coupling the motor and the ribbon driver, the coupler being capable of receiving ribbon drivers of various diameters. An ink-dispenser for dispensing ink onto the ribbon in the ribbon cartridge is movable relative to the ribbon cartridge to allow it to be brought above and into contact with the ribbon in the ribbon cartridge. An ink cartridge having a ribbon to be re-inked is secured to the base such that the exposed portion of the ribbon faces upward, the ink dispenser is placed above and in contact with the exposed portion of ribbon, and a pre-determined quantity of ink is placed in the ink dispenser. The motor is coupled to the ribbon driver and the ink is dispensed from the ink dispenser as the motor turns the ribbon driver. When all of the ink is dispensed, the motor is shut off.

13 Claims, 6 Drawing Sheets

RIBBON RE-INKING METHOD AND APPARATUS

BACKGROUND OF THE INVENTION

1. Field of the Invention

The present invention relates to a system for re-inking ribbons. More particularly, the present invention relates to a method of and apparatus for re-inking ribbons in ribbon cartridges and spools used in cash registers, computer printers, and typewriters, for example.

2. General Background of the Invention

Single-pass carbon ribbon cartridges are sometimes used in computer printers and some typewriters. In cash registers, however, continuous-loop fabric ribbon cartridges are usually used (these continuous-loop fabric ribbon cartridges are often used in computer printers, word processors, and typewriters, too). The continuous-loop fabric ribbon cartridges have ink in the ribbon thereof, which ink is transferred to paper when hit by a print wheel, for example. Eventually the supply of ink becomes so low that the quality of print is no longer acceptable. At that point, the continuous-loop fabric ribbon cartridges, which incidentally usually last much longer than the single-pass carbon ribbon cartridges, are usually thrown away.

Lately, however, with the increased concern for the environment and the wish to conserve resources, these continuous-loop fabric ribbon cartridges are being recycled by re-inking them. Two patented systems for re-inking these cartridges are shown in U.S. Pat. No. 4,948,275, issued on 14 August 1990 to Kuhn et al., and U.S. Pat. No. 5,035,522, issued on 30 July 1991 to Wright. However, both of these systems require that a portion of the ribbon be withdrawn from the cartridge to come into contact with the ink applicator, which is a rather messy chore and can damage delicate plastic parts of the cartridge.

SUMMARY OF THE INVENTION

The apparatus of the present invention solves the problems confronted in the art in a simple and straightforward manner. What is provided is a ribbon re-inking method and apparatus which allows the ribbon in virtually any type of continuous-loop fabric ribbon cartridge to be re-inked, and to be re-inked without any of the ribbon being withdrawn from the cartridge. The ink dispensing means is movable relative to the ribbon cartridge, which allows the ribbon to be re-inked without being withdrawn from the cartridge. Because the ribbon need not be withdrawn from the cartridge, the ribbon can be re-inked without getting ink on the person operating the apparatus.

The apparatus of the present invention for re-inking ribbons in ribbon cartridges comprises a base, a securing means for securing a ribbon cartridge to the base, a drive means for turning the ribbon driver of the ribbon cartridge, coupling means for coupling the drive means and the ribbon driver, the coupling means having a variable-diameter receiving means for receiving ribbon drivers of various diameters, an ink-dispensing means for dispensing ink onto the ribbon in the ribbon cartridge, and means for moving the ribbon cartridge relative to the ink-dispensing means. If more than one type of ribbon was to be re-inked with the apparatus of the present invention (or if not all the ribbons to be re-inked could be turned at the same speed) one could use a drive means which is variable in speed.

The method of the present invention of re-inking ribbon cartridges having an exposed portion of ribbon and a ribbon driver comprises securing an ink cartridge to a base such that the exposed portion of the ribbon faces upward, placing an ink-dispensing means above the exposed portion of ribbon, measuring a pre-determined quantity of ink, placing the predetermined quantity of ink in the ink-dispensing means, coupling a drive means to the ribbon driver with a variable-diameter coupling means, rotating the ribbon driver with the drive means until the pre-determined quantity of ink is dispensed onto the ribbon. The ink-dispensing means is preferably placed in physical contact with the ribbon, and the ribbon preferably makes at least 5 full revolutions as the ink is being dispensed onto the ribbon.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

Figure 1:
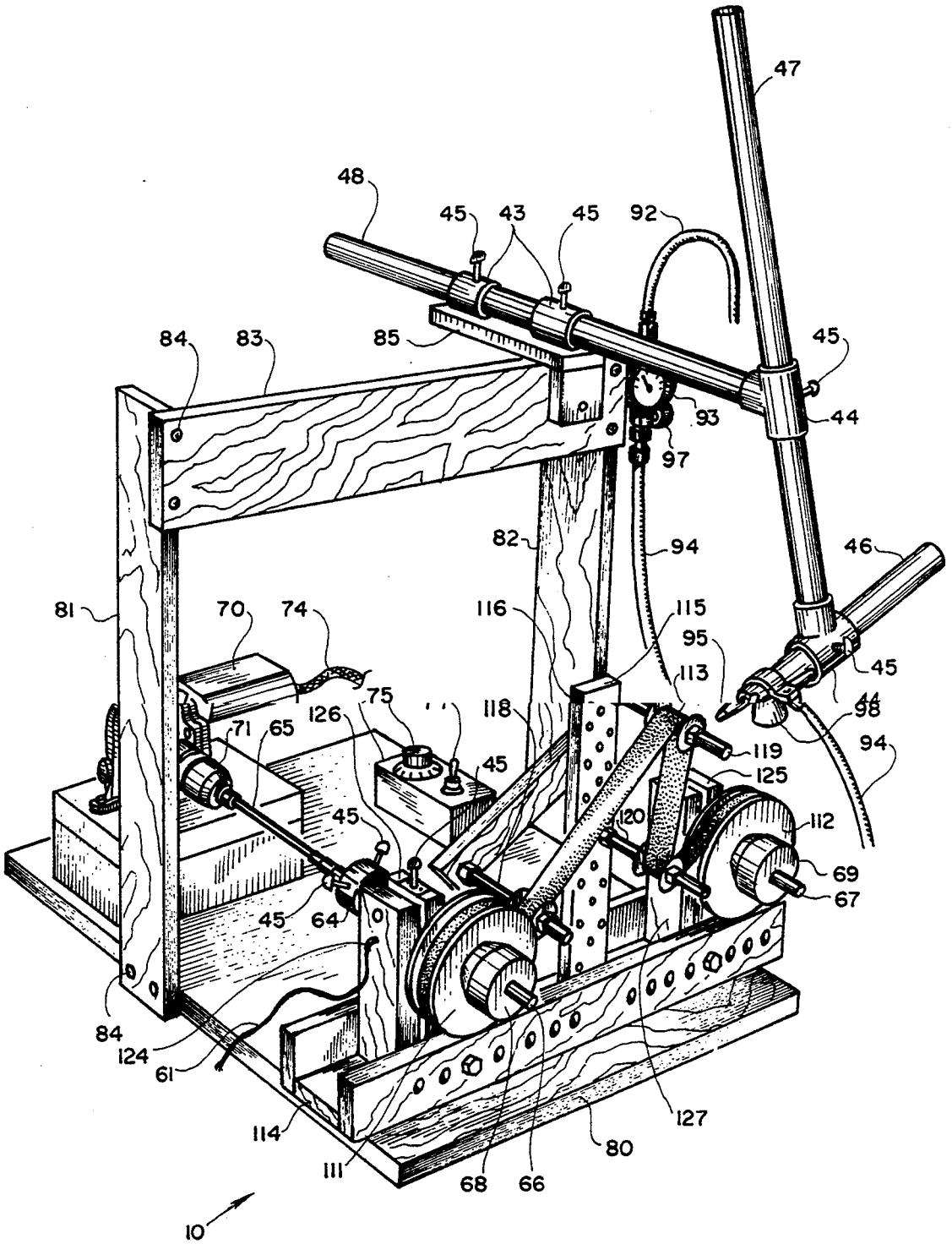
FIG. 1 is a perspective view of the preferred embodiment of the apparatus of the present invention, set up for re-inking ribbon spools.
Figure 2:
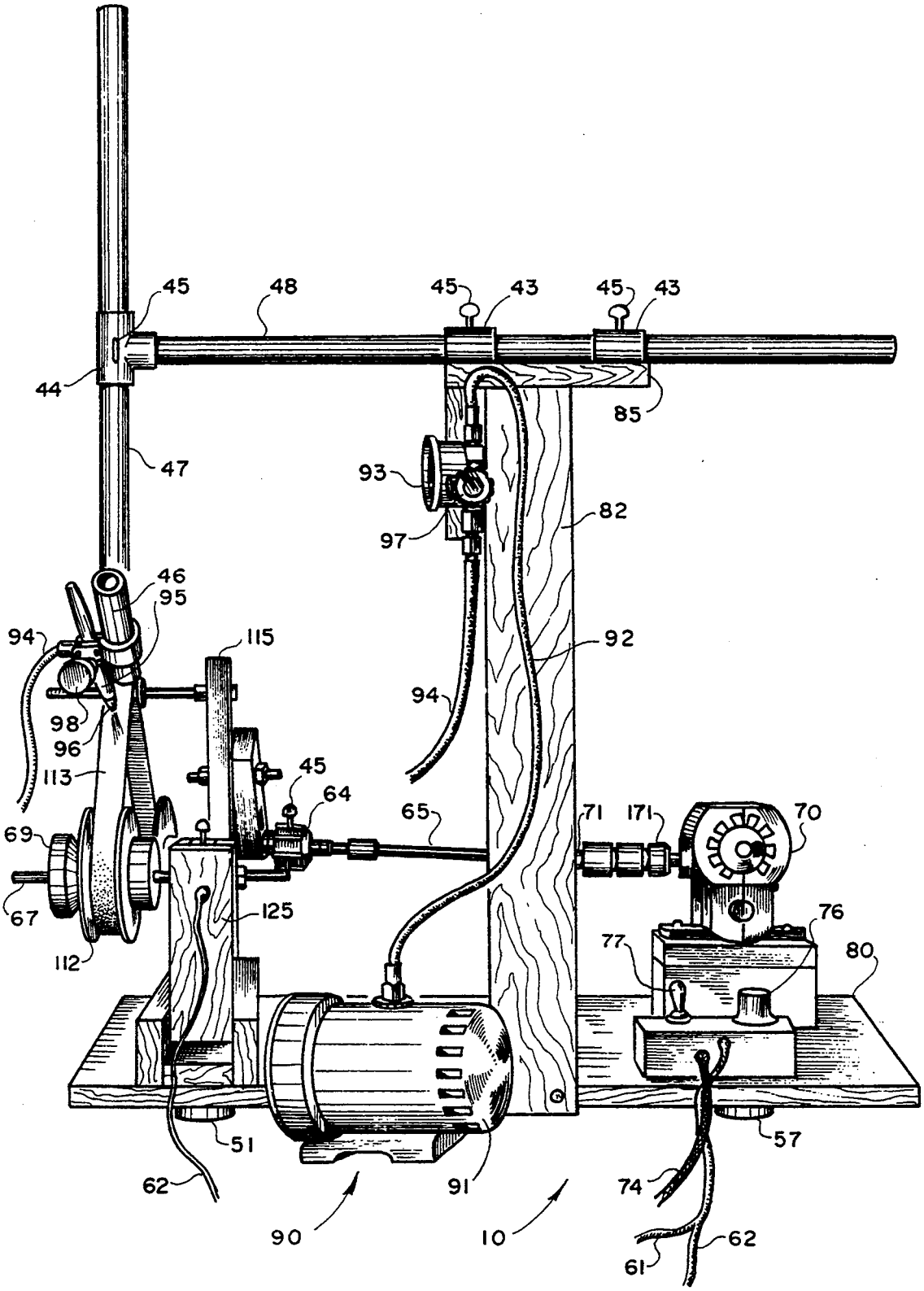
FIG. 2 is a right side view of the embodiment of the apparatus of the present invention shown in FIG. 1.

PARTS LIST:

The following is a list of suitable parts and materials for the various elements of the preferred embodiment of the present invention.

10 apparatus of the preferred embodiment of the present invention

20 side-driven continuous-loop fabric ribbon cartridge

21 exposed portion of ribbon 22

22 ribbon in side-driven continuous-loop fabric ribbon cartridge 20

23 ribbon driver of side-driven continuous-loop fabric ribbon cartridge 20

30 side-driven continuous-loop fabric ribbon cartridge

31 exposed portion of ribbon 32

32 ribbon in side-driven continuous-loop fabric ribbon cartridge 30

33 ribbon driver of side-driven continuous-loop fabric ribbon cartridge 30

40 ink dispenser
41 ink reservoir
42 ink dispenser nozzle (such as a cap from an Elmer's brand glue bottle)
43 sleeve
44 T-joint
45 adjusting screw
46 lower horizontal pipe of ink dispenser 40
47 vertical pipe of ink dispenser 40
48 upper horizontal pipe of ink dispenser 40
51 sleeve for receiving pipe 55 of securing shelf 52
52 securing shelf
53 horizontal ledge of securing shelf 52
54 L-shaped support of securing shelf 52
55 vertical adjusting pipe of securing shelf 52
56 vertical adjusting pipe of securing shelf 58
57 sleeve for receiving pipe 56 of securing shelf 58
58 securing shelf
59 L-shaped support of securing shelf 58
60 horizontal ledge of securing shelf 58
61 wire for automatic cut-off switch (Radio Shack Part No. 275-1566 - not shown) for gear motor 70
62 wire for automatic cut-off switch (Radio Shack Part No. 275-1566 - not shown) for gear motor 70
64 adjustable-diameter knob holder (plastic)
65 flexible coupling rod for connecting chuck 71 to axle 66 or 67
66 axle
67 axle
68 beveled securing lug
69 beveled securing lug
70 variable-speed gear motor (preferably Daton AC/DC Gear Motor Model No. 1L481 (100 r.p.m.) or Model 1L483 (21 r.p.m.))
71 chuck of variable-speed gear motor 70
72 gripping fingers of chuck 71
73 receptacle of chuck 71
74 power cord for gear motor 70
75 control box for gear motor 70
76 speed-varying control of gear motor 70 (Daton Stock No. 4X797)
77 toggle switch of gear motor 70 (Archer Model No. 275-1533)
80 base of apparatus 10
81 vertical support of apparatus 10, preferably made of wood
82 vertical support of apparatus 10, preferably made of wood
83 horizontal support of apparatus 10, preferably made of wood
84 screws
85 movable horizontal support of apparatus 10, preferably made of wood
90 ink jet apparatus
91 compressor for ink jet apparatus 90 (Charge Air Model WB-1000)
92 hose for ink jet apparatus 90
93 pressure gauge for ink jet apparatus 90
94 hose connecting pressure gauge 93 and ink jet 95
95 ink jet (Badger Model 200)
96 nozzle of ink jet 95
97 control knob for ink jet apparatus 90
98 control knob for ink jet 95
101 vertical direction arrow
102 horizontal direction arrow
103 horizontal direction arrow
104 round direction arrow
105 round direction arrow
106 round direction arrow
110 movable support (bolted or C-clamped onto vertical support 115)
111 spool
112 spool
113 ribbon
114 horizontal support trough
115 vertical support, preferably made of wood
116 holes in vertical support 115
117 holes in horizontal support trough 114
118 all-thread rod
119 all-thread rod
120 all-thread rod
121 ribbon guide
122 ribbon guide
123 ribbon guide
124 switch post
125 switch post
126 pivoting post for receiving axle 66
127 pivoting post for receiving axle 67
171 chuck

DETAILED DESCRIPTION OF THE PREFERRED EMBODIMENT

FIGS. 1 through 4 show the preferred embodiment of the apparatus 10 of the present invention set up for re-inking ribbon spools. This set-up will be described after the setups shown in FIGS. 5 and 7.

Apparatus 10 of the preferred embodiment of the present invention (see FIG. 5) includes a base 80, a pair of vertical supports 81 and 82, both preferably made of wood, a fixed horizontal support 83, and a movable horizontal support 85. Screws 84 help connect supports 81 and 82 to base 80 and to fixed horizontal support 83.

Figure 9:
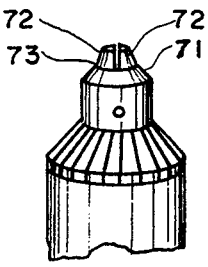
FIG. 9 is a detail of the chuck of the gear motor of the preferred embodiment of the apparatus of the present invention.

There is a variable-speed gear motor 70 for turning the ribbon to be re-inked in the ribbon cartridges. Attached to the axle (not shown) of motor 70 is a first chuck 171 which is rigidly attached to a second chuck 71 with an all-thread rod (not shown in the drawings). Chucks 71 and 171 have the same components, so only chuck 171 will be described in detail. Chuck 71 (see FIG. 9) has a receptacle 73 which is variable in diameter to allow motor 70 to turn ribbons in ribbon cartridges having ribbon drivers of various diameters. Chuck 71 includes gripping fingers 72. Motor 70 includes a power cord 74. There is a control box 75 for gear motor 70 which includes a speed-varying control 76 and a toggle switch 77. Toggle switch 77 switches motor 70 between off, clockwise rotation, and counterclockwise rotation. Motor 70 is bolted to a movable wooden L 107 which rests on base 80 but is not rigidly attached thereto. Motor 70 is heavy enough not to need to be secured to base 80, and may be freely moved as needed to be positioned properly in relation to a ribbon cartridge whose ribbon is being re-inked by the apparatus of the present invention.

The preferable ink to use in the apparatus of the present invention is black dot matrix ink (such as the ink manufactured by Computer Friends of 14250 Northwest Science Park Drive, Portland, Oreg. 97229). Other colors can be used as desired.

Figures 5, 6:
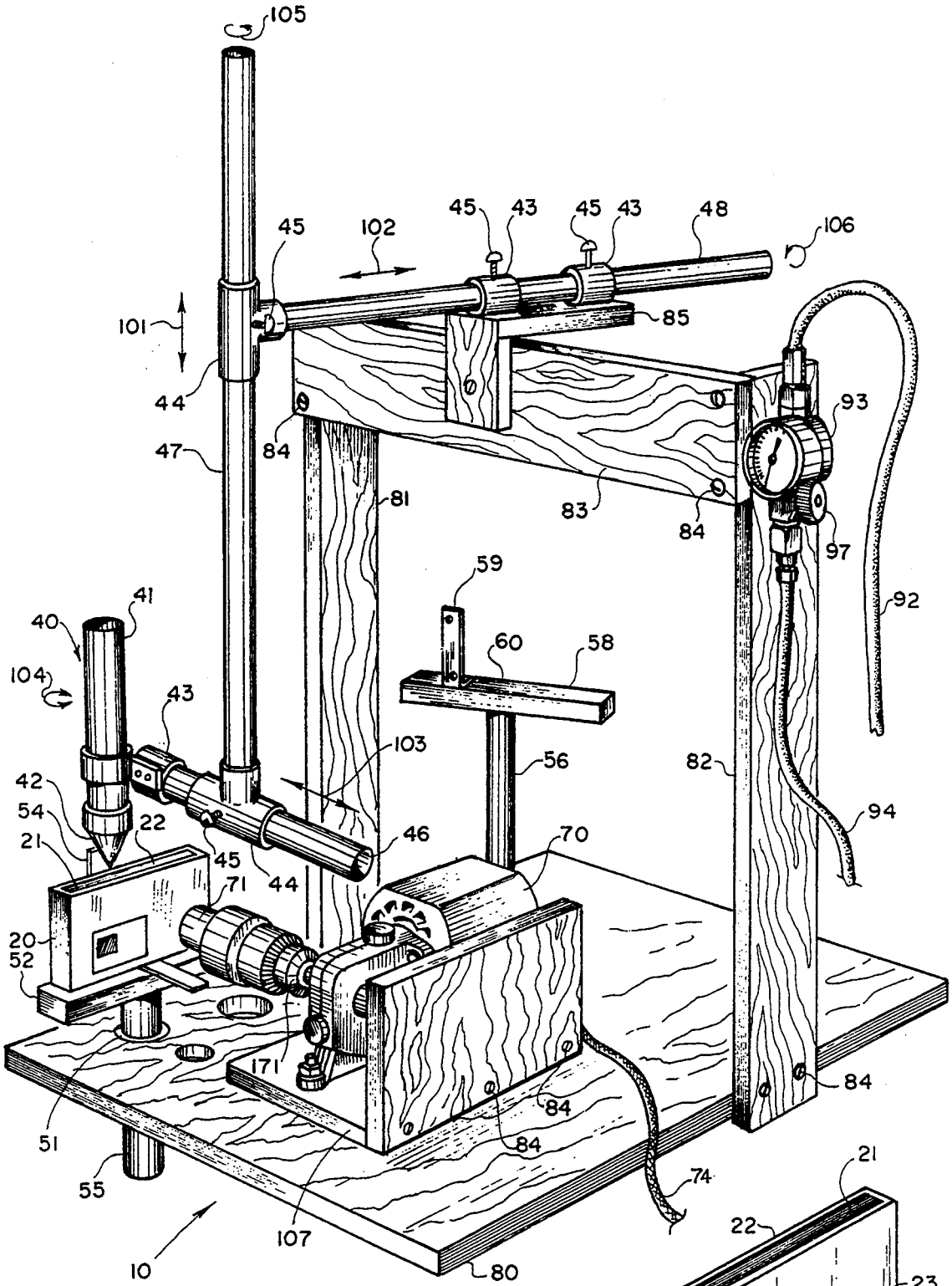
FIG. 5 is a perspective view of the preferred embodiment of the apparatus of the present invention, set up for re-inking side-driven continuous-loop fabric ribbon cartridges.
FIG. 6 is a perspective view of a side-driven continuous-loop fabric ribbon cartridge.

FIG. 5 shows the preferred embodiment of the apparatus 10 of the present invention set up for re-inking side-driven continuous-loop fabric ribbon cartridges 20. FIG. 6 is a perspective view of a side-driven continuous-loop fabric ribbon cartridge 20 showing its ribbon driver 23. Side-driven continuous-loop fabric ribbon cartridge 20 includes a ribbon 22 which has an exposed portion 21. A ribbon driver 23 can be rotated to rotate ribbon 22 in cartridge 20.

FIG. 5 shows an ink dispenser 40 in place of the ink jet apparatus 90 shown in FIGS. 1–4, and securing shelves 52 and 58 in place of horizontal support trough 114 shown in FIGS. 1–4.

Figure 3:
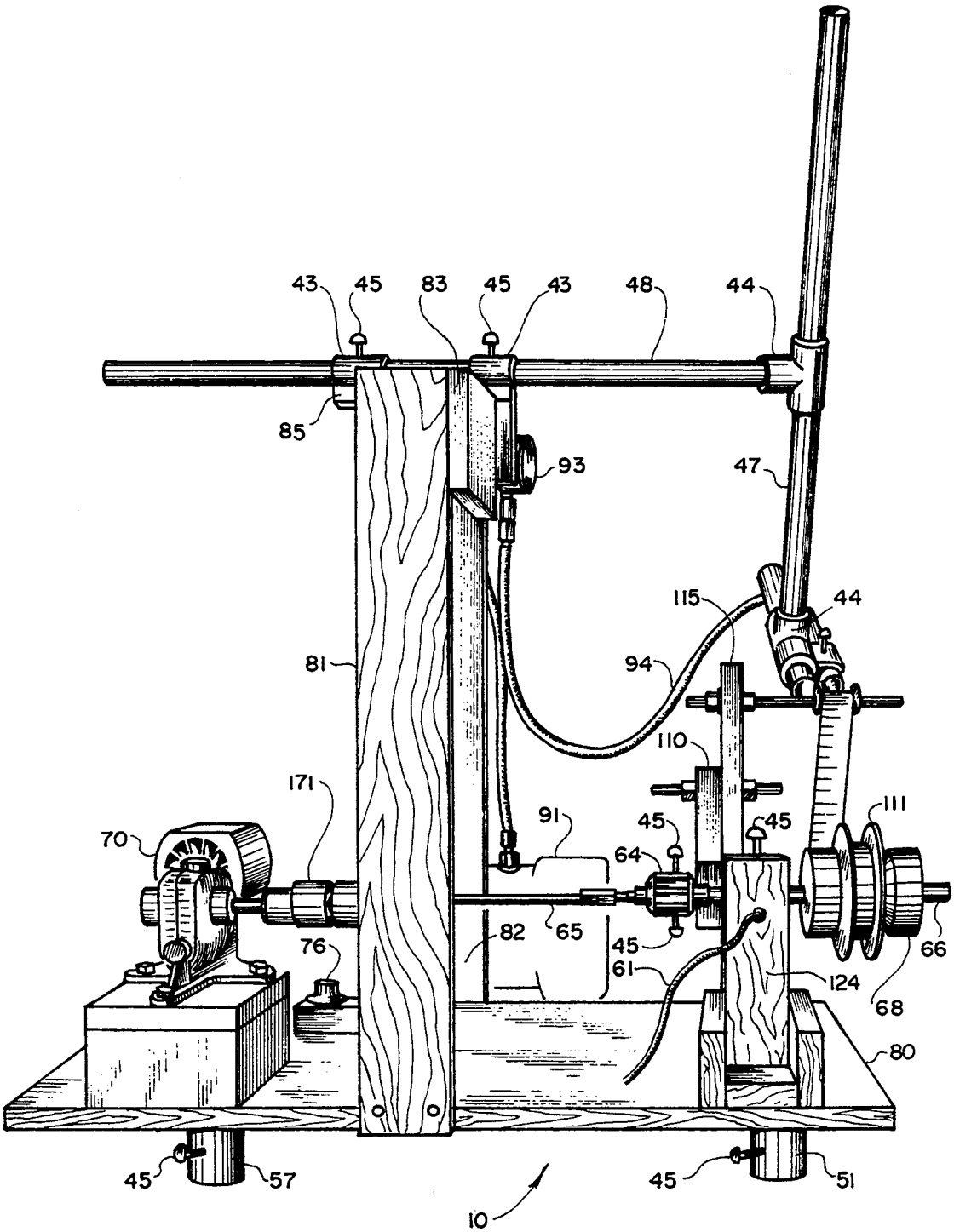
FIG. 3 is a left side view of the embodiment of the apparatus of the present invention shown in FIG. 1.
Figure 4:
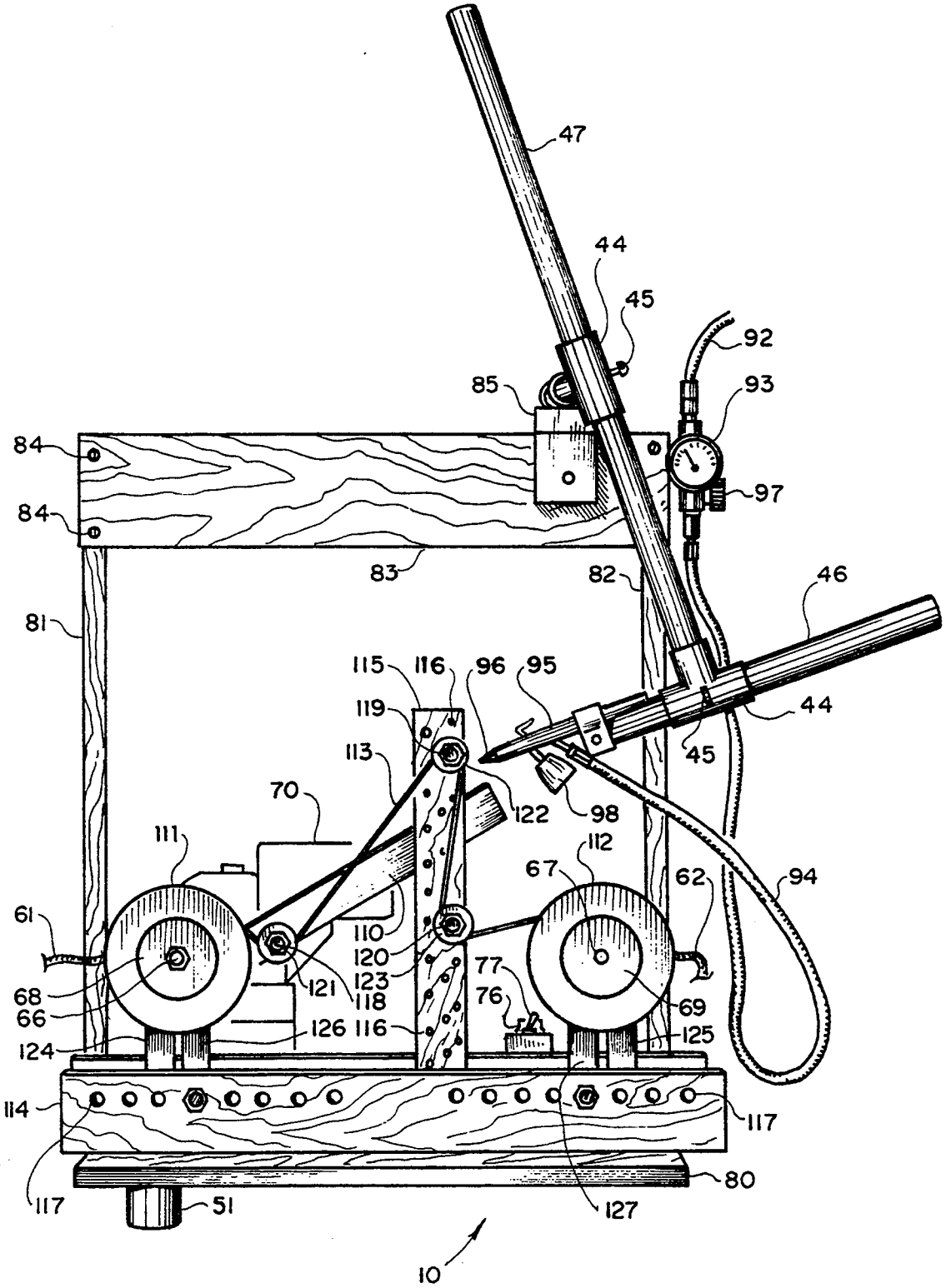
FIG. 4 is a front view of the embodiment of the apparatus of the present invention shown in FIG. 1.
Figure 7:
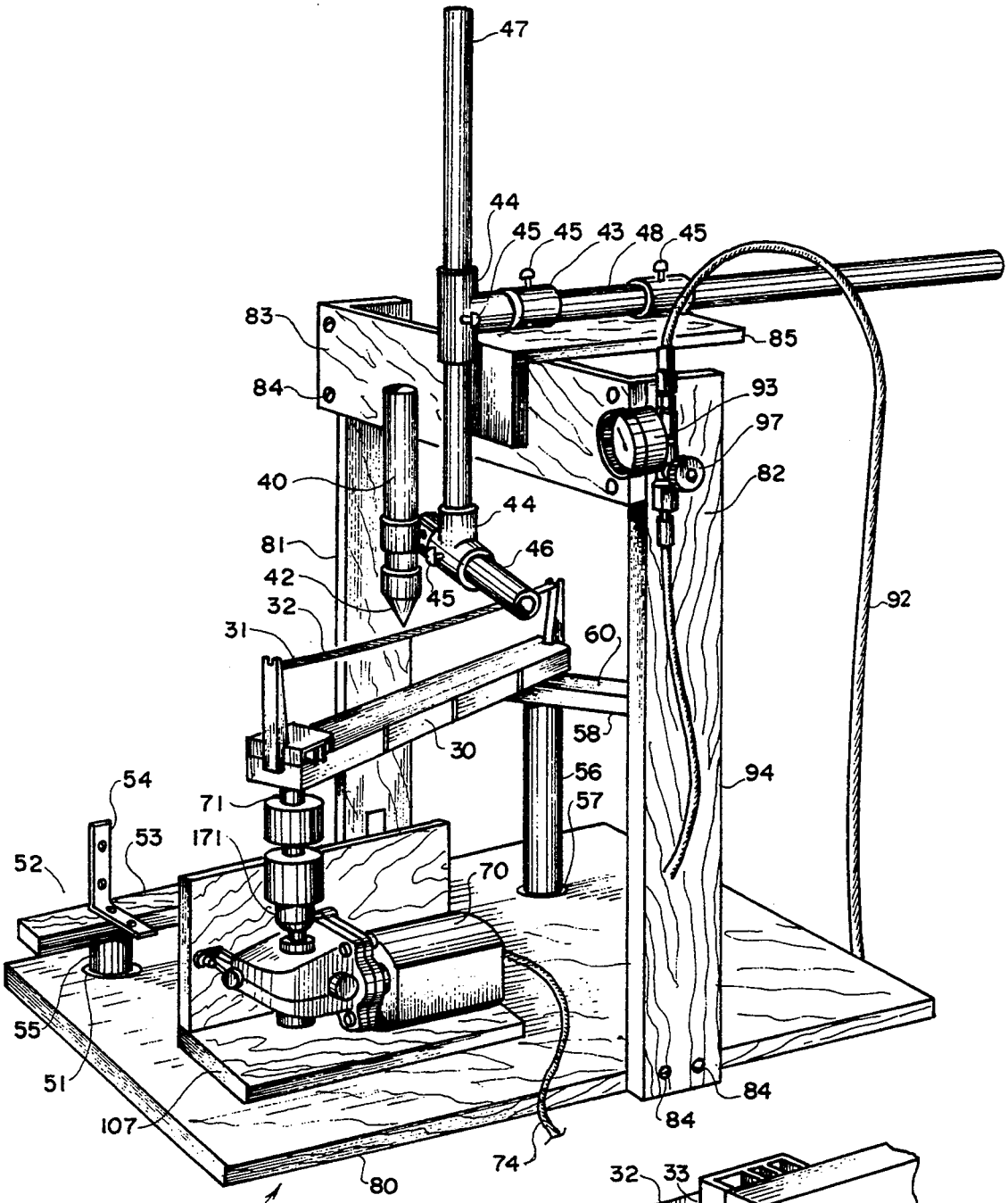
FIG. 7 is a perspective view of the preferred embodiment of the apparatus of the present invention, set up for re-inking rear-driven continuous-loop fabric ribbon cartridges.

Base 80 includes holes therein in which are inserted sleeves 51 and 57 (see FIG. 3). In FIGS. 5 and 7, sleeve 51 receives pipe 55 of securing shelf 52 and sleeve 57 receives pipe 56 of securing shelf 58. Securing shelf 52 includes a horizontal ledge 53 atop vertical adjusting pipe 55. Ledge 53 has thereon an L-shaped support 54.

Securing shelf 58 includes a horizontal ledge 60 atop a vertical adjusting pipe 56 and an L-shaped support 59 on ledge 60.

Ink dispenser 40 includes an ink reservoir 41 which has disposed at a first, lower end thereof an ink dispenser nozzle 42. Nozzle 42 can be, for example, a cap such as the cap of an Elmer's brand glue bottle. The second, upper end of reservoir 41 is open to allow ink to be poured into reservoir 41.

Reservoir 41 is secured to a sleeve 43, which is slidingly received on a lower horizontal pipe 46. Lower horizontal pipe 46 is slidingly received in the lower part of lower T-joint 44. The T-joint 44 is attached to vertical pipe 47, which is slidingly received in upper T-joint 44. Upper T-joint 44 is attached to upper horizontal pipe 48, which is slidingly received in upper sleeves 43, which are themselves rigidly attached to movable horizontal support 85.

Each sleeve 43 and each T-joint 44 has an adjusting screw 45 therein for frictionally engaging the respective pipe received therein to allow adjustment of the positioning of ink dispenser 40 relative to side-driven fabric ribbon cartridge 20.

Vertical pipe 47 can slide up and down in upper T-joint 44 in the direction of vertical direction arrow 101, thus causing ink dispenser 40 to move up and down in the direction of vertical direction arrow 101. Horizontal pipe 48 can slide back and forth in upper sleeves 43 in the direction of horizontal direction arrow 102, thus causing ink dispenser 40 to likewise move back and forth in the direction of horizontal direction arrow 102. Horizontal pipe 46 can slide back and forth in lower T-joint 44 in the direction of horizontal direction arrow 103, thus causing ink dispenser 40 to likewise move back and forth in the direction of horizontal direction arrow 103. Further adjustment of the location and orientation of ink dispenser 40 can be had be rotating pipe 46 as indicated by 104 round direction arrow, by rotating pipe 47 as indicated by round direction arrow 105, and by rotating pipe 48 as indicated by round direction arrow 106.

Pipes 46, 47, 48, 55, and 56 may be made of, for example, ½ inch or ¾ inch schedule 40 PVC pipe. Fittings 43 and 44 may likewise be made of PVC.

In operation, movable horizontal support 85 is attached to fixed horizontal support 83 at an appropriate location, such as in the center thereof as shown in FIG. 5. A screw can be used to secure horizontal support 85 to horizontal support 83. Otherwise, a C-clamp, for example, could be used. A ribbon cartridge 20 whose fabric ribbon 22 is to be re-inked is attached to horizontal ledge 53 of securing shelf 52, for example, by using a C-clamp or a rubber band to secure cartridge 20 to L-shaped support 54. Vertical adjusting pipe 55 is moved in sleeve 51 so that ribbon driver 23 is at the proper height to be received in receptacle 73 of chuck 71, and then the adjusting screw 45 in sleeve 51 is tightened. Motor 70 is then moved toward cartridge 20 and ribbon driver 23 is received in receptacle 73 of chuck 71, and chuck 71 is tightened such that gripping fingers 72 grip ribbon driver 23. Pipes 46, 47, and 48 are all adjusted as needed to place ink dispenser 40 above ribbon cartridge 20, with ink nozzle 42 in contact with the exposed portion 21 of ribbon 22. A predetermined amount of ink is measured and placed in ink reservoir 41. Ink nozzle 42 is then opened to allow flow of ink from reservoir 41 onto the exposed portion 21 of ribbon 22 (ink nozzle 42 can be closed to prevent ink from flowing from reservoir 41 when reservoir 41 is placed upright as shown in FIGS. 5 and 7). Right after ink nozzle 42 is opened, toggle switch 77 (see FIG. 1) is switched to turn on motor 70 (the direction does not matter when re-inking ribbons in ribbon cartridges) at a predetermined speed set by speed control 76 (see FIG. 1). Motor 70 is run until a predetermined time period has passed (enough time to allow all of the ink in reservoir 41 to flow to ribbon 22). Motor 70 can be allowed to continue to run thereafter without harmful effect on the ribbon 22. The amount of ink to use, the speed (in r.p.m.) at which to turn the ribbon driver, and the amount of time required to dispense the predetermined amount of ink on the ribbon are all determined by trial and error the first time (or first few times) that the ribbon in a particular model of ribbon cartridge is re-inked, and all of this information is stored (preferably on a computer) for future reference. Some models of ribbon cartridges can be re-inked in about 3 minutes, some can take more than an hour, with most of the models which the inventors are re-inking now taking less than 10 minutes.

Figure 8:
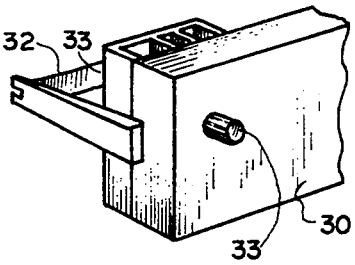
FIG. 8 is a partial view of a rear-driven continuous-loop fabric ribbon cartridge.

FIG. 7 shows the preferred embodiment of the apparatus 10 of the present invention set up for re-inking the ribbon 32 of a rear-driven continuous-loop fabric ribbon cartridge 30. FIG. 8 is a partial view of a rear-driven continuous-loop fabric ribbon cartridge 30 showing the ribbon driver 33. Rear-driven continuous-loop fabric ribbon cartridge 30 includes a ribbon 32 which has an exposed portion 31. A ribbon driver 33 can be rotated to rotate ribbon 32 in cartridge 30.

To re-ink fabric ribbon 32 of ribbon cartridge 30, first motor 70 is placed as shown in FIG. 7, with chuck 71 facing upward. Ribbon cartridge 30 is placed on top of horizontal ledge 60 of securing shelf 58, with ribbon driver 33 (see FIG. 8) being received in receptacle 73 of chuck 71 (pipe 56 is adjusted to get ledge 60 to the proper height). Chuck 71 is tightened such that gripping fingers 72 grip ribbon driver 33. A C-clamp or a rubber band can be used to secure cartridge 30 to ledge 60. Vertical adjusting pipe 56 is moved in sleeve 57 so that ribbon cartridge 30 is substantially level, and then the adjusting screw 45 in sleeve 57 is tightened to maintain the relative positioning of pipe 56 and sleeve 57.

Movable horizontal support 85 is attached to fixed horizontal support 83 at an appropriate location, such as near the center thereof as shown in FIG. 7. A screw or a C-clamp can be used to secure horizontal support 85 to horizontal support 83. Pipes 46, 47, and 48 are all adjusted as needed to place ink dispenser 40 above ribbon cartridge 30, with ink nozzle 42 in contact with the exposed portion 31 of ribbon 32. A predetermined amount of ink is measured and placed in ink reservoir 41. Ink nozzle 42 is then opened to allow flow of ink from reservoir 41 onto the exposed portion 21 of ribbon 22. Right after ink nozzle is opened, toggle switch 77

(see FIG. 1) is switched to turn on motor 70 at a predetermined speed set by speed control 76 (see FIG. 1). Motor 70 is run until a predetermined time period has passed (enough time to allow all of the ink in reservoir 41 to flow to ribbon 32). Motor 70 can be allowed to continue to run thereafter without harmful effect on the ribbon 32.

Speed does not have much effect on the quality of the re-inking job done, except that the speed is preferably great enough that the ribbon makes at least 5 full revolutions while the ink is being dispensed thereon, and preferably great enough that the ribbon makes at least 7 full revolutions while the ink is being dispensed thereon. Otherwise, the ink may be noticeably disproportionately distributed on the ribbon (for example, if only 1½ revolutions are made while the ink is being dispensed, then half of the ribbon will have twice as much ink as the other half). Another potential solution would be to time the rotation such that a single revolution (or any whole number of revolutions) is made from the time the ink begins dispensing to the time that it finishes; however, this would be rather difficult to figure out, so it is better to just ensure that at least 5 revolutions are made while the ink is being dispensed.

Also, the speed should not be so great as to stress the ribbon cartridge (some ribbon cartridges (such as Genicom 3800 series cartridges) are rather fragile and should not be rotated at a speed of over 10 r.p.m.). Most fabric ribbon cartridges with which the inventors have experience have ribbons which can be turned at approximately 20 r.p.m. without any damage occurring to the ribbon cartridge.

FIGS. 1 through 4 show the preferred embodiment of the apparatus 10 of the present invention set up for re-inking ribbon spools.

In FIGS. 1–4, instead of ink dispenser 40, an ink jet apparatus 90 is used. This is because it is difficult to properly distribute ink from dispenser 40 onto a ribbon on spools because the ribbon 113 on spools 111 and 112 cannot be rapidly moved passed nozzle 42 several times in succession - rather, motor 70 must be shut off each time one end of ribbon 113 is reached and then the direction of motor 70 needs to be reversed. In the time that it takes for this to happen, too much ink would get deposited at one location on ribbon 113. Therefore, to avoid this problem, ink jet apparatus 90 is used, which allows ink to be evenly spread onto ribbon 113 when ribbon 113 makes a single pass by ink jet nozzle 96. Instead of using ink jet apparatus 90, the inventors also contemplate using multiple reservoirs 41 and nozzles 42 simultaneously to dispense ink onto ribbon 113; if set up properly, it is contemplated that the multiple nozzles (perhaps five) would lay parallel lines of ink and all the ink needed to re-ink the ribbon 113 would be applied in a single pass by the nozzles.

Ink jet apparatus 90 includes an ink jet 95 having a nozzle 96. There is a compressor 91 for ink jet apparatus 90, which is attached by hose 92 to a pressure gauge 93. Hose 94 connects pressure gauge 93 and ink jet 95. Control knob 97 controls the pressure of the ink, and control knob 98 controls the amount of ink spraying from nozzle 96. By varying the pressure of the ink and amount that sprays out of nozzle 96, and by varying the speed at which motor 70 turns spool 111 or 112, the proper amount of ink can be sprayed onto ribbon 113 in a single pass. The inventors are working on an alternative to ink jet apparatus 90 which will be less messy and less hazardous (ink droplets become suspended in the air with ink jet apparatus 90, requiring the use of exhaust fans when spool ribbons are re-inked.

In FIGS. 1–4, a horizontal support trough 114 replaces securing shelves 52 and 58. Spools 111 and 112 are supported on axles 66 and 67, respectively, and are centered by way of beveled securing lugs 68 and 69, respectively. Lugs 68 and 69, as can be seen in the drawings, include a cylindrical portion and a cone-shaped portion which comes into contact with spools 111 and 112. Axles 66 and 67 are themselves supported by pivoting posts 126 and 127, respectively. Ribbon 113 is threaded around ribbon guides 121, 122, and 123. Ribbon guides 121, 122, and 123 are respectively received on all-thread rods 118, 119, and 120. All-thread rods 119 and 120 are received in holes 116 in vertical support 115. There are holes 117 in horizontal support trough 114 to allow selective lateral spacing of spools 111 and 112. Movable support 110 is bolted or C-clamped onto vertical support 115, and receives all-thread rod 118.

Ribbon guides 121 and 123 serve to keep ribbon 113 straight when leaving and returning to spools 111 and 112. Ribbon guide 122 serves to bring ribbon 113 into close proximity with ink jet nozzle 96.

Adjacent each pivoting post 126 and 127 is a switch post 124 and 125, respectively. Each switch post 124, 125 has disposed therein an automatic cut-off switch (preferably one such as Radio Shack Part No. 275-1566 - not shown) for automatically shutting off gear motor 70. These switches are connected to motor 70 with wires 61 and 62. When the end of a spool 111 or 112 is reached, the ribbon 113 pulls on the spool and causes pivoting post 126 or 127 to pivot toward the vertical support 115, drawing pivoting post 126 or 127 away from switch post 124 or 125, and causing the switch in the switch post to shut off motor 70.

A flexible coupling rod 65 is used to connect chuck 71 to axle 66 or 67. Adjustable-diameter knob holder 64 is disposed at one end of flexible coupling rod 65. Knob holder 64 is tightened onto axle 66 or 67 by turning the adjusting screws 45 therein. Knob holder 64 can also be used with the equipment shown in FIG. 5 to couple motor 70 to those ribbon cartridges having large-diameter ribbon drivers (that is, so large that they cannot fit into chuck 71).

Adjusting screws 45 in pivoting posts 126 and 127 are used to press against axles 66 and 67 to allow the proper tension to be put on ribbon 113.

In operation, spools 111 and 112 are received on axles 66 and 67, respectively, and lugs 68 and 69 are tightened, centering spools 111 and 112 on axles 66 and 67. Ribbon 113 is threaded onto guides 121, 122, and 123. Flexible coupling rod 65 is used to connect chuck 71 to axle 66, for example. Since coupling rod 65 is flexible, it is not necessary to line up chuck 71 at the same height as axle 66 or 67 - coupling rod 65 either bends upward or downward to make contact with and receive axle 66 or 67. If axle 66 is being received in the chuck of rod 65, then the adjusting screw 45 in pivoting post 127 is adjusted to cause there to be the proper tension on ribbon 113 when motor 70 is turned on. The proper, predetermined pressure and jet nozzle opening are set on ink jet apparatus 90, and the proper speed and direction are set on control box 75. The compressor 91 and motor 70 are then preferably started at the same time, and ink is applied onto ribbon 113 until all of ribbon 113 is on spool 111 and then ribbon 113 pulls pivot post 127 away from switch post 125, causing the switch in switch post 125 to automatically shut off motor 70 (and preferably to automatically shut off compressor 91). If a single pass is not sufficient to properly re-ink ribbon 113, then rod 65 is moved to axle 67, motor 70 is reversed, and the process begins again.

The following table lists the amount of ink required for certain specified ribbons. This information was obtained through trial and error. The maximum speed at which a ribbon can be turned without damaging delicate plastic parts has also been determined by trial and error.

| Ribbon | Amount of ink |
|---|---|
| Accel 500 series | 3 cc |
| Epson LQ850 | 2 cc |
| Epson LQ1000 | 2.6 cc |
| Epson MX/FX 80 | 2 cc |
| Epson 7754 | 3 cc |
| Epson 7762L | 2.5 cc |
| Epson 8755 | 2.5 cc |
| Epson 8766 | 10 cc |
| Genicom 3800 series | 4.6 cc |
| IBM 1040150 | 3.5 cc |
| IBM 1040930 | 3 cc |
| IBM 6295158 | 25 cc |
| ISC Bunker Ramo 01-00457-001 | .4 cc |
| Memorex 3205-1077 | 1 cc |
| NCR 198747 | 20 cc |
| Nukote BM 188 | 1.5 cc |
| Okidata 393 | 5.3 cc |
| Okidata 2350/2410 | 12 cc |
| Okidata 52102001 | 1.5 cc |
| Panasonic KX-P140 | 1.5 cc |
| Panasonic KX-P145 | 2.5 cc |
| Panasonic KX-P155 | 1.5 cc |
| Pelikan P177 | 2 cc |
| Tandy DMP107 | 1.7 cc |

Although apparatus 10 is shown as comprising quite a bit of wood, it could be made, for example, with plastic or metal in place of the wood.

The foregoing embodiments are presented by way of example only; the scope of the present invention is to be limited only by the following claims.

We claim:

1. Apparatus for re-inking ribbons in ribbon cartridges having an exposed portion of ribbon and a ribbon driver, the apparatus comprising:

(a) a base means;

(b) securing means for securing a ribbon cartridge including a protruding ribbon driver to the base means;

(c) a drive means for turning a ribbon driver of a ribbon cartridge;

(d) coupling means for coupling the drive means and a ribbon driver of a ribbon cartridge, the coupling means having a variable-diameter receiving means for receiving ribbon drivers of various diameters without removing the receiving means from the apparatus;

(e) means for adjusting the variable-diameter receiving means so as to clamp ribbon drivers of various diameters;

(f) an ink-dispensing means for dispensing ink onto ribbon in a ribbon cartridge; and (g) adjusting means for moving the ink-dispensing means away from and relative to a ribbon cartridge which has a ribbon driver coupled to the drive means after the ribbon driver is coupled to the drive means.

2. The apparatus of claim 1, wherein: the drive means is variable in speed.

3. The apparatus of claim 1, wherein:

when the base means is horizontal, the securing means secures a ribbon cartridge in an orientation such that an exposed portion of ribbon in the cartridge faces upward.

4. The apparatus of claim 1, wherein:

the adjusting means enables physical contact of the ink-dispensing means and an exposed portion of a ribbon.

5. The apparatus of claim 1, wherein: the adjusting means includes means for moving the ink-dispensing means relative to the base means.

6. The apparatus of claim 6, wherein:

the adjusting means includes means for moving a ribbon cartridge which has a ribbon driver coupled to the drive means relative to the base means.

7. The apparatus of claim 1, wherein:

the adjusting means includes means for moving a ribbon cartridge which has a ribbon driver coupled to the drive means relative to the base means.

8. The apparatus of claim 1, wherein: the ink-dispensing means dispenses ink through a gravity feed.

9. The apparatus of claim 1, further comprising:

(h) attachment means for attaching ribbon spools to the base means, the ribbon spools having wound thereon re-inkable ribbon; and (i) switch means for automatically shutting off the drive means when the ribbon has been completely unwound from one of the ribbon spools, wherein:

(j) the coupling means enables coupling of the drive means and the ribbon spools;

(k) the ink-dispensing means is capable of dispensing ink onto the ribbon wound on the ribbon spools;

(l) the adjusting means enables movement of the ink-dispensing means relative to the ribbon spools.

10. A method of re-inking ribbon cartridges having an exposed portion of ribbon and a protruding ribbon driver, comprising:

(a) securing a ribbon cartridge to a base means such that the exposed portion of the ribbon faces upward;

(b) placing an ink-dispensing means above the exposed portion of the ribbon;

(c) measuring a pre-determined quantity of ink;

(d) placing the pre-determined quantity of ink in the ink-dispensing means;

(e) providing a drive means:

(f) providing a coupling means having a variable-diameter receiving means and adjusting means;

(g) coupling said drive means to the ribbon driver with said variable-diameter receiving means;

(h) adjusting the diameter of said variable-diameter receiving means so as to clamp the ribbon driver;

(i) rotating the ribbon driver with the drive means until the pre-determined quantity of ink is dispensed onto the ribbon.

11. The method of claim 10, wherein:

the ink-dispensing means is placed in physical contact with the ribbon.

12. The method of claim 10, wherein:

the ribbon makes at least 5 full revolutions as the ink is being dispensed onto the ribbon.

13. The method of claim 10, wherein:

the drive means is variable in speed.

* * * * *